US006626111B2

(12) United States Patent
Hirsch

(10) Patent No.: US 6,626,111 B2
(45) Date of Patent: Sep. 30, 2003

(54) METHOD OF PRODUCING CUSTOMIZABLE, MULTI-DIMENSIONAL PRINT MEDIA AND DIE-PRESSED PRINT MEDIA

(76) Inventor: Harvey L. Hirsch, 118 Panorama Dr., Edgewater, NJ (US) 07071

( * ) Notice: Subject to any disclaimer, the term of this patent is extended or adjusted under 35 U.S.C. 154(b) by 124 days.

(21) Appl. No.: 09/779,895

(22) Filed: Jan. 12, 2001

(65) Prior Publication Data

US 2002/0094211 A1 Jul. 18, 2002

(51) Int. Cl.[7] ..... G09F 1/04; G09F 1/06; G09F 1/08; A63H 33/16

(52) U.S. Cl. ..... 101/486; 101/485; 446/388; 40/124.09; 40/124.14; 40/124.19; 40/124.16; 229/116.3; 229/116.1

(58) Field of Search ..... 446/387, 388; 40/124.08, 124.09, 124.11, 124.12, 124.13, 124.14, 124.15, 124.16, 124.19, 124.01; 400/578, 719; 229/116.1, 116.2, 116.3, 116.4, 116.5; 493/53–55; 101/483, 485, 486

(56) References Cited

U.S. PATENT DOCUMENTS 4,084,015 A * 4/1978 Patterson ..... 428/9
4,668,211 A 5/1987 Lubotta et al.
4,708,285 A 11/1987 Segall
5,083,389 A * 1/1992 Alperin ..... 40/539
5,333,780 A 8/1994 Scott
RE35,067 E 10/1995 Bauknecht
5,887,366 A * 3/1999 Volkert et al. ..... 40/124.08
5,888,183 A * 3/1999 Ruthenberg et al. ..... 493/160
6,117,061 A * 9/2000 Popat et al. ..... 493/325
6,173,649 B1 * 1/2001 Onishi ..... 101/483
6,257,404 B1 * 7/2001 Tracy et al. ..... 206/232
6,277,456 B1 * 8/2001 Bulgrin et al. ..... 156/270

OTHER PUBLICATIONS

Paper Direct Catalog PF101.2A (2001), cover page, pp. 2–3, 8–9, C, 76–77, 81 and last page. Admitted as prior art to instant application.
Brochure by Helmold, cover page, pp. 5, 8–9 and last page. Admitted as prior art to instant application.
Brochure by Ken, cover page, page containing heading "Mirco Perforating Rule," and last page. Admitted as prior art to instant application.

* cited by examiner

*Primary Examiner*—Daniel J. Colilla
(74) *Attorney, Agent, or Firm*—Charles E. Bruzga

(57) ABSTRACT

Method of producing multi-dimensional print media, comprising the following steps: Providing a substantially flat sheet of print media. Providing an image for printing on a first side of the sheet; the image including an active area that eventually separates from the rest of the sheet; the active area being bounded by a periphery. Performing one or both of cutting and microperfing a substantial portion of the periphery that adjoins an adjacent portion of the sheet. Scoring the first side of the sheet in the active area to provide at least one fold line for facilitating folding of the sheet into a multi-dimensional shape using only the at least one fold line for folding. Printing the image on the first side of the sheet with a printing device. The foregoing performing step is carried out in such manner as to keep the sheet sufficiently intact while passing through a printing device so as to prevent malfunction of the printing device. Die-pressed print media is also provided for use in the method.

22 Claims, 9 Drawing Sheets

METHOD OF PRODUCING CUSTOMIZABLE, MULTI-DIMENSIONAL PRINT MEDIA AND DIE-PRESSED PRINT MEDIA

FIELD OF THE INVENTION

The present invention relates to a method of method of producing customizable, multi-dimensional print media and to die-pressed print media that can be used in the method.

BACKGROUND OF THE INVENTION

A traditional method to create multi-dimensional print media includes the following three steps performed in sequence. First, one prints an image on a flat sheet of print media, such as paper or card stock, Second, using a die pattern for the print media, one then die cuts and scores ("die presses") the already printed sheet. Third, various segments are removed from the sheet and folded to create multi-dimensional print media A drawback of the traditional method is that the print image is fixed for an entire production run. This makes the per-piece cost for small production runs too costly for many potential users. It would be desirable to provide a method to create multi-dimensional print media that considerably reduces the per-piece cost for small production runs, and to provide die-pressed print media that can be used in the method.

SUMMARY OF THE INVENTION

An exemplary embodiment of the invention provides a method of producing multidimensional print media, comprising the following steps: Providing a substantially flat sheet of print media Providing an image for printing on a first side of the sheet; the image including an active area that eventually separates from the rest of the sheet; the active area being bounded by a periphery. Performing one or both of cutting and microperfing a substantial portion of the periphery that adjoins an adjacent portion of the sheet. Scoring the first side of the sheet in the active area to provide at least one fold line for facilitating folding of the sheet into a multi-dimensional shape using only the at least one fold line for folding. Printing the image on the first side of the sheet with a printing device. The foregoing performing step is carried out in such manner as to keep the sheet sufficiently intact while passing through a printing device so as to prevent malfunction of the printing device.

Another embodiment of the invention provides a substantially flat sheet of print media The sheet includes an active area that may be separated from the rest of the sheet, the active area being bounded by a periphery. A substantial portion of the periphery is one or both cut and microperfed in such manner as to adequately hold the active region to the rest of the sheet to such a degree that the sheet can be passed through an appropriate device for printing intended indicia on the sheet without causing malfunction of such device. The sheet includes at least one score line in the active region for providing at least one fold line to facilitate folding of the sheet into a multi-dimensional shape using only the at least one fold line for folding.

The foregoing method creates multi-dimensional print media with considerably reduced per-piece cost for small production runs, and the foregoing die-pressed print media can be used in the method.

DETAILED DESCRIPTION OF THE INVENTION

Figure 1:
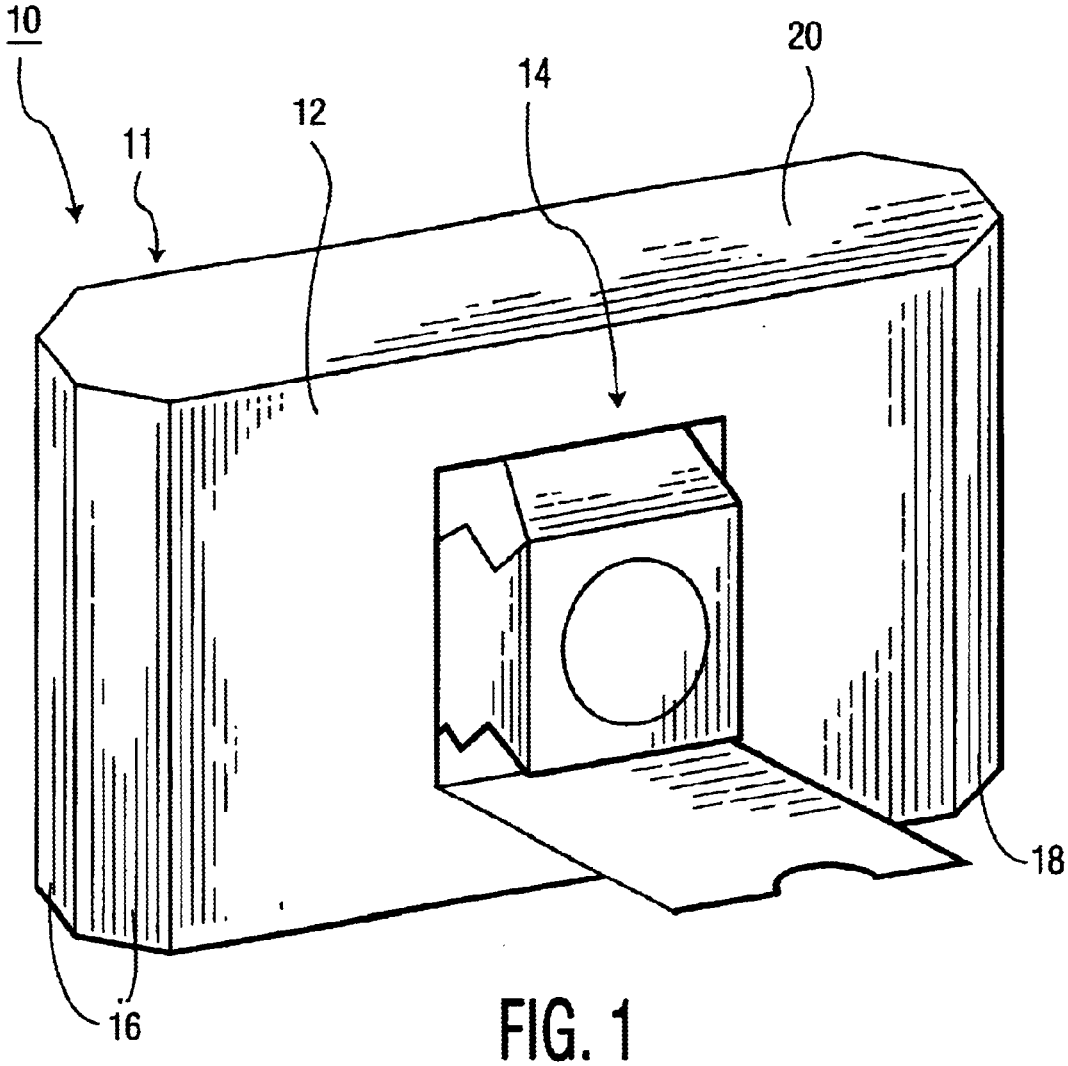
FIG. 1 is a perspective view of multi-dimensional print media that can be made according to the present invention.

FIG. 1 shows a multi-dimensional print medium 10 having the shape of a photographic camera Medium (or camera) 10 has a camera body 11 including a front portion 12 and a lens assembly 14 projecting through the camera body. Camera body 11 includes side portions 16 and 18 respectively joined to the front portion, and a top portion 20. Print in the form of non-textual graphics 22 and 24 and text 26 appear on various portions of the camera.

Camera 10 has the appearance of a three-dimensional object when viewed from the perspective of FIG. 1, although some parts may be open as at 13. "Three-dimensional" is intended to be included under the broader term "multi-dimensional" that is more fully defined with respect to FIGS. 11, 13 and 14.

Figure 2:
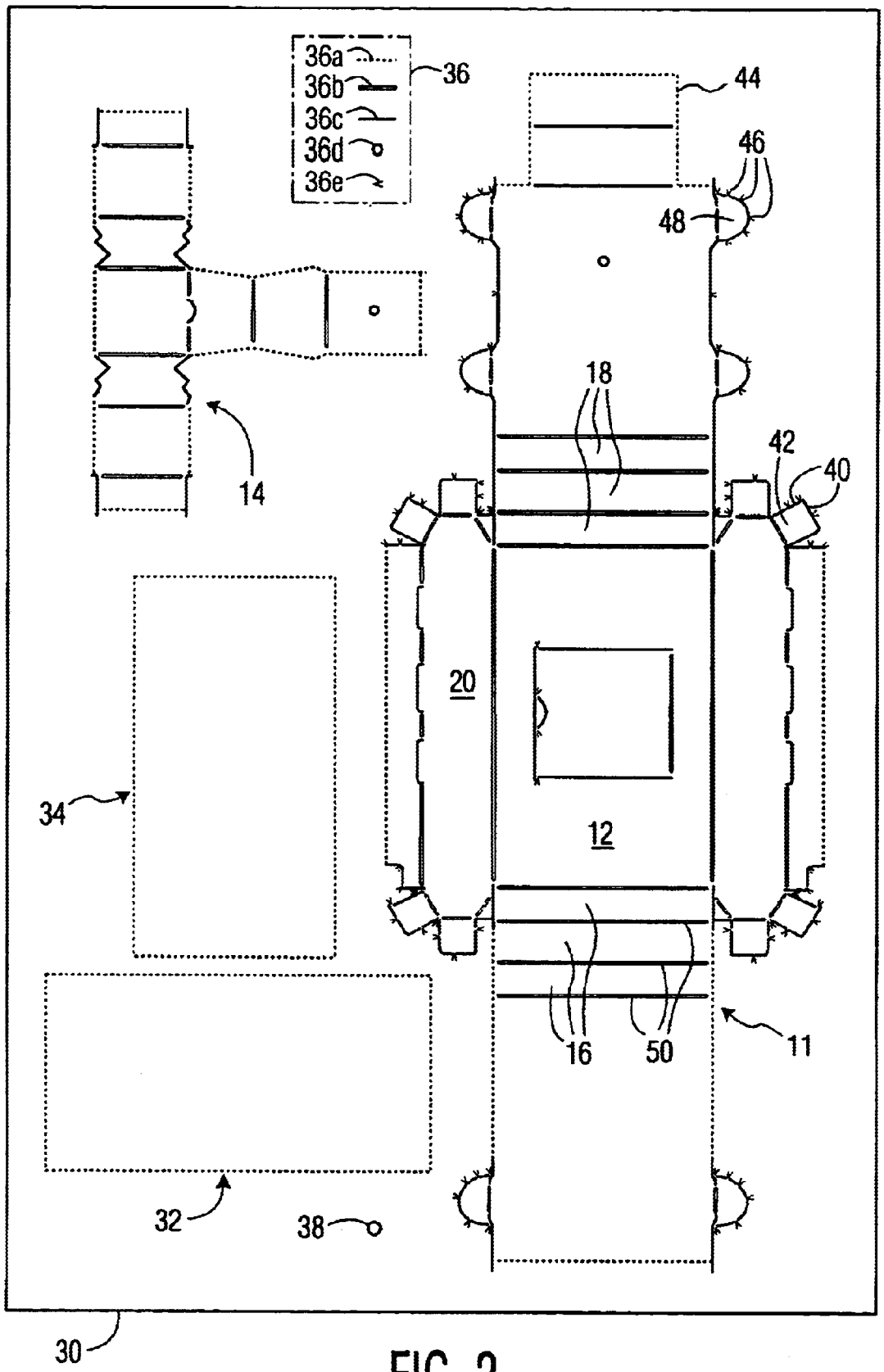
FIG. 2 is a top plan view of an unprinted sheet of print media that can be used to form the multi-dimensional print medium of FIG. 1.

The invention allows camera 10 with its printed images of text or graphics to be produced from a preferably blank sheet 30 of print media shown in FIG. 2. Sheet 30, which preferably is substantially flat, has undergone a die press process (not shown) of, preferably, microperfing, cutting and scoring. Such process defines the following segments of the sheet: 11 (camera body), 14 (lens assembly), and 32 and 34 that are optional, as they do not form part of camera 10 (FIG. 1).

A legend 36 shows a dotted line style 36*a* for microperfing, a double line style 36*b* for scoring, a solid line style 36*c* for cutting, a circle 36*d* for a punched-through hole, and a symbol (">") 36*e* indicating a nick. Legend 36 is shown in a phantom box to indicate its actual absence from sheet 30. These processes are now further described.

Concerning the various die press processes, an alignment hole 38 produced from a punch-through die (not shown) is located on sheet 30. FIG. 2 shows the front portion 12 of camera body 11, its side portions 16 and 18 and its top portion 20. As can be seen from legend 36, various portions of the periphery of body 11, such as edges 40 of tab 42, are cut away from the remainder of the sheet. Other portions of body 11 are microperfed, as shown at 44. Still other portions of the body are not cut, as at nicks 46 of tab 48, which result from respective small gaps in a cutting die (not shown) that otherwise cuts the tab in a generally semicircular shape. Scoring lines, as at 50, define lines for bending the adjacent portions. For instance, fold lines 50 guide bending of the various side portions 16 of camera body 11, which are shown bent in FIG. 1. To effect the die press process, preferably a single diehead (not shown) is pressed in one operation from above (from the perspectives of FIGS. 2 and 4 onto sheet 30. Respective portions of the die produce the microperfed, scored and cut areas. A scoring (non-cutting) die portion presses against the top of the sheet, producing a "valley" (not shown) on the top of the sheet and a usually a "ridge" (not shown) on the bottom of the sheet.

Most preferably, as shown in FIG. 2, substantially all portions of the periphery of camera body 11 that are not cut are microperfed. This allows easy removal of the camera body from the rest of the sheet after a subsequent printing operation. Preferably, this is true for the other segments (e.g., 14 and 32) of the sheet. Designs other than for the specific camera body shown in FIG. 2 may not require cutting. However, preferably, at least a substantial portion, meaning here at least about 50 percent, of the periphery of any segment is one or both of microperfed and cut, more preferably at least about 75 percent, even more preferably at least about 85 percent. "Approximately" can be substituted for "about" as used in the various ranges mentioned herein to provide more exact definition.

Figure 4:
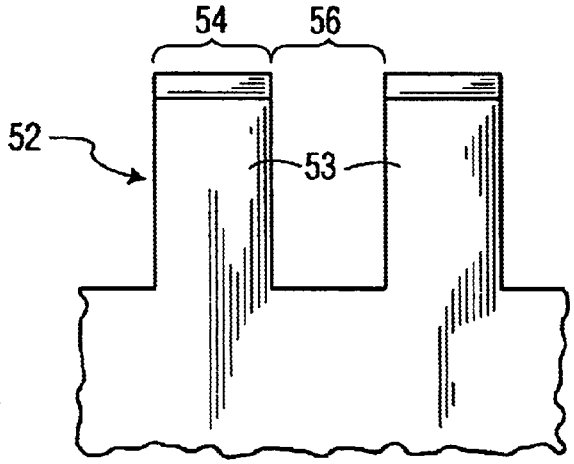
FIG. 4 shows a fragmentary portion of a segment of the sheet of FIG. 2 after a print image has been applied to it.

The various segments on the sheet (e.g., 11 or 14) define active areas for receiving print images (not shown). To allow tolerances in aligning sheet 30 in a printing device, a printimage may extend beyond the periphery of each active area. For instance, FIG. 4 shows a print image 58 extending beyond the periphery of the fragmentary portion of the lens assembly 14. In this regard, preferably the entire periphery of segment 11 or 14, for example, is inwardly spaced from the edges of the sheet to allow a so-called "bleed" or tolerance band 59 around the segment. Band 59 may be greater than about ¼ inch (6.35 mm) in dimension 60 assuming image 58 is perfectly aligned with segment (or active area) 14.

Figure 3:
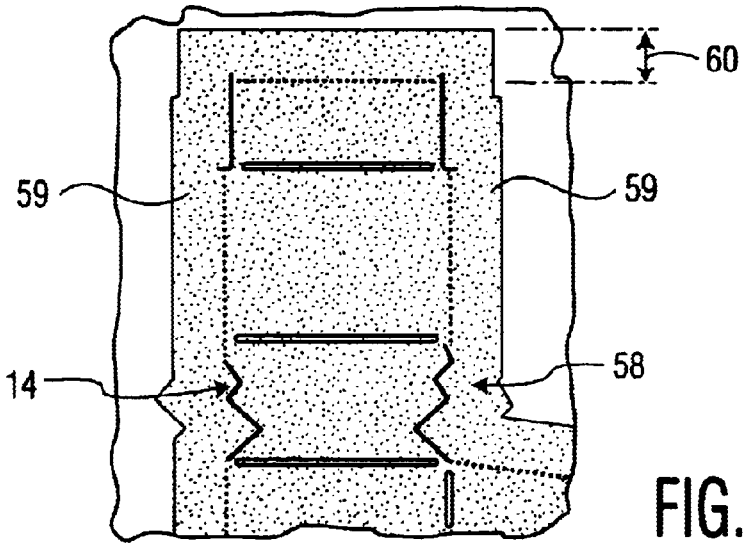
FIG. 3 is a fragmentary side view of a multiperfing diehead that may be used in producing the sheet of FIG. 2.

To keep the various segments of the sheet (e.g., 11 or 14, FIG. 2) intact during a subsequent printing operation, an appropriate microperfing diehead (not shown) should be used, The sheet is considered intact if none of the segments tear away from the rest of the sheet while passing through a printing device so as to become undesirably bent or jam the device. For instance, as shown in FIG. 3, for card stock with a weight of 285 grams per square meter, a part description of 0.937 2 PT 50T/010×010 MICRO PERF SUPREME diehead 52 having fifty teeth 53 per inch, with a tooth width 54 of 10 mils and a "tie" length 56 of 10 mils, as sold by Seabord Steel Rule Co. of Bristol, Conn., U.S.A., typically will suffice. (The part description means a 0.937 inch high die, with a 28 mil thick body, fifty teeth per inch and tooth and tie width of each 10 mils. The selection of a suitable microperfing diehead (or dieheads) will be obvious to those of ordinary skill in the art based on the present specification.

Figure 5:
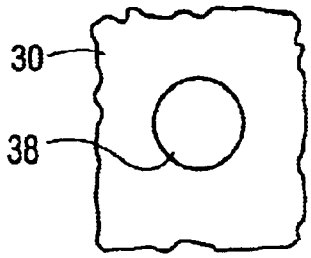
FIGS. 5–6 are plan views of a fragmentary portion of a sheet of print media having features for aligning a print image onto the sheet.
Figure 6:
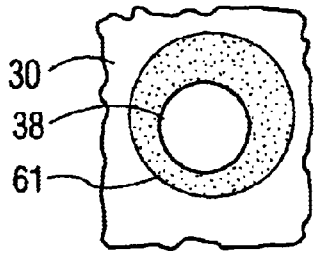

As shown in FIG. 4, image 58 can be properly aligned with the die-pressed paper segment 14 in the following manner. Referring to FIGS. 5–6, hole 38 may be punched through a test sheet 30 used for testing alignment in a die press operation. Then, a mark 61 may be printed on the test sheet, such as by printing a circular dot preferably larger than hole 38. This may be in addition to other print indicia provided on the sheet. In a preferred method as shown, if the periphery of mark 61 remains intact, then proper alignment is indicated. This provides an easy visual indication that alignment is proper. If the hole breaches (or crosses) the periphery of mark 61, improper alignment is indicated. Repositioning of an image to be printed with respect to a sheet to be fed through a printing device is then required.

Many alternatives to the hole and circular dot of FIGS. 5–6 will be apparent to those of ordinary skill in the art based on the present specification. Further alternatives (not shown) include deforming the sheet with microperfing, scoring or cutting dies, by way of example. Preferably, the larger of the deformed region in the sheet and a printed mark defines a generally enclosed shape, with alignment being indicated if the other of the region and mark falls within such shape.

Figure 7:
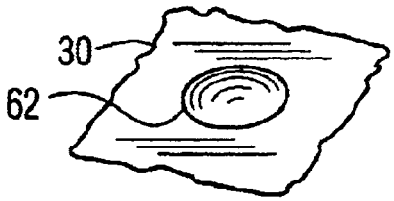
FIGS. 7–8 are perspective views of a fragmentary portion of a sheet of print media having different features for aligning a print image onto the sheet.
Figure 8:
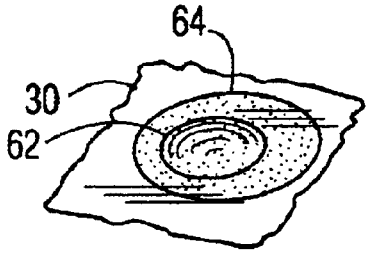

As an alternative to hole 38 in FIGS. 5–6, phantom lines 39*a* may be formed, for instance, from microperfing, scoring or cutting. Point 39*b* is actually the operative deformed area of the sheet, which, when it falls within printed indicia or mark 61, indicates proper alignment Additionally, as shown in FIG. 7, a deformed (e.g., depressed) region 62 could be formed in sheet 30 with appropriate embossing or debossing dies (not shown). As shown in FIG. 8, a circular dot 64 larger than deformed region 62 could then be printed on a test sheet.

Figure 9:
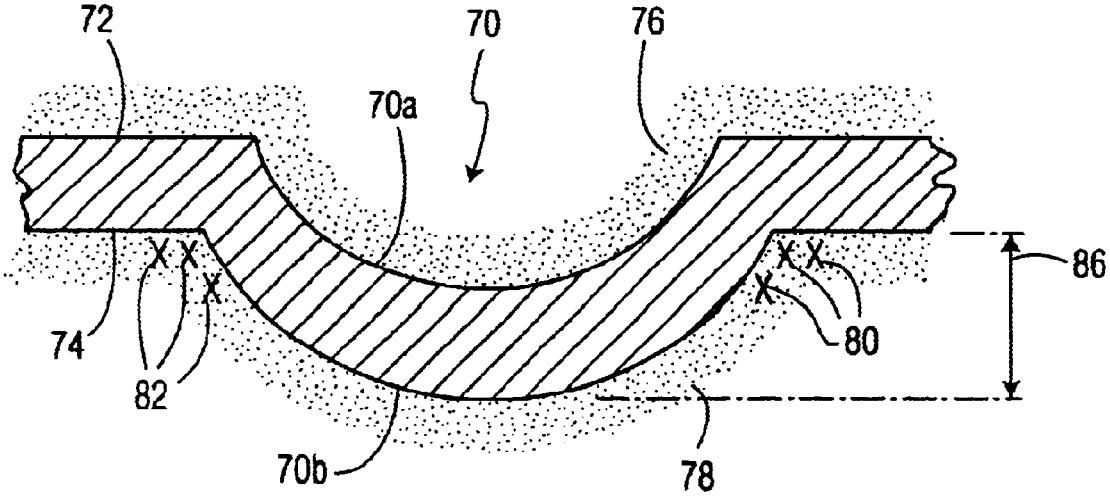
FIG. 9 is a cross section of an enlarged, fragmentary portion of a sheet of print media after undergoing a scoring operation.

During the die press operation described above, a scoring die (not shown) creates scoring or fold lines such as 50 in FIG. 2. FIG. 9 shows an enlarged, cross sectional view of a scoring line 70. Line 70 includes what is referred to herein as a valley 70*a* when viewed from the perspective of a first side 72 of sheet 30, and a ridge 70*b* when viewed from the perspective of a second side 74.

Usually, a print medium 76 such as toner or ink (shown as stippled for convenience) can be printed on first side 72 of the sheet, across valley 70, with generally uniform coverage. Thus, print indicia such as a colored area (not shown) formed by print medium 76 that crosses valley 70 will maintain substantially uniform color quality. For this reason, first side 72 is usually the first choice for receiving a printed image. In contrast, a print medium 78 provided on second side 74 might lack substantially uniform coverage. Print medium 78 may be substantially thinner in the respective vicinities of areas 80 and 82 (shown with x's for convenience). This will cause a colored region (not shown), for example, crossing over ridge 70*b* to have a substantially lighter color near 80 and 82.

To avoid the problem of too light coverage of print medium, it is preferable to limit the height of the ridge. Thus, one preferably selects scoring diehead that keeps dimension 86 (FIG. 9) of the ridge below about 6 mils, more preferably below about 3 mils, and even more preferably below about 2 mils.

Figure 10:
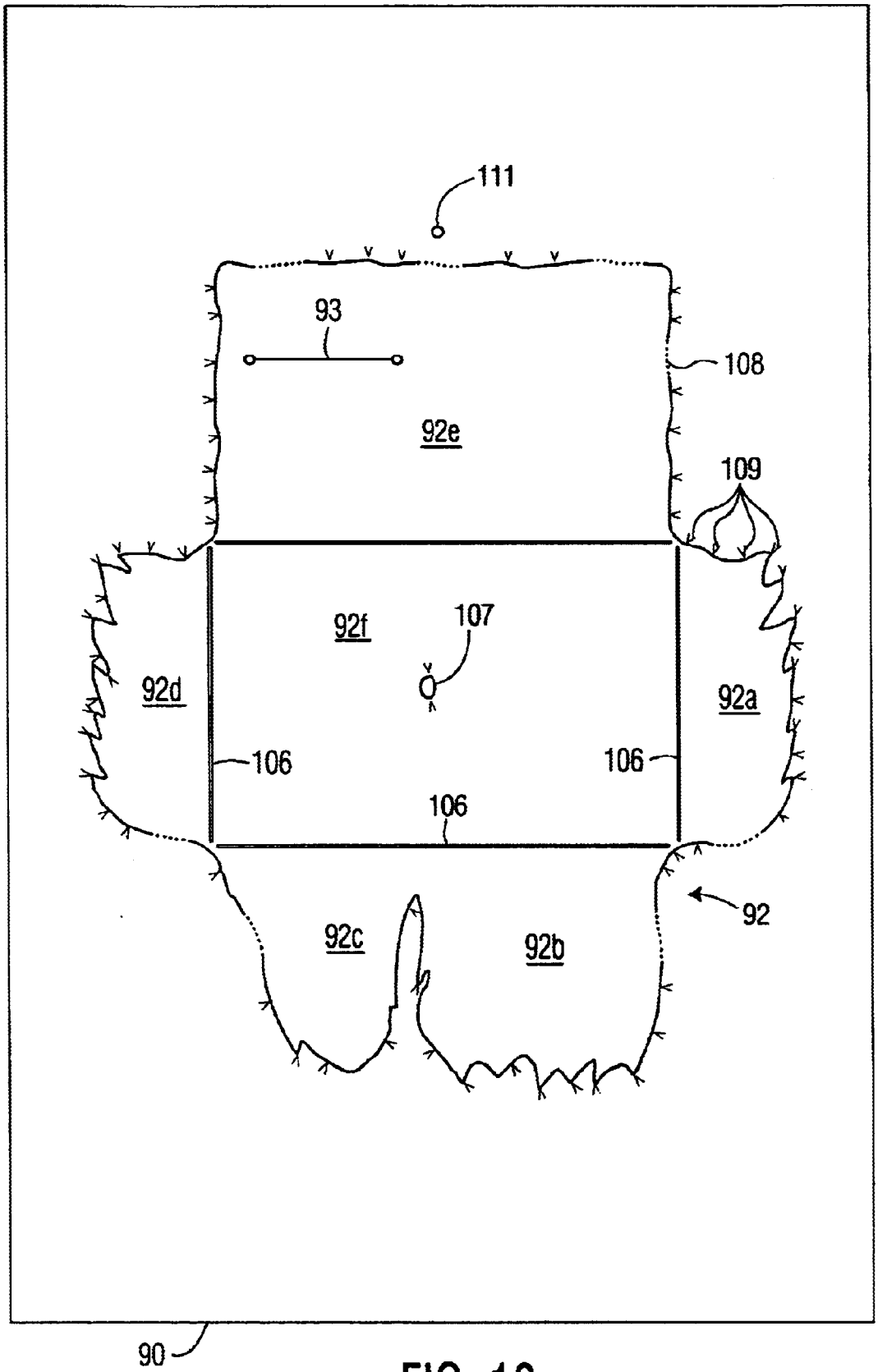
FIG. 10 is a top plan view of an unprinted sheet of print media that can be used to form another multi-dimensional print medium.
Figure 11:
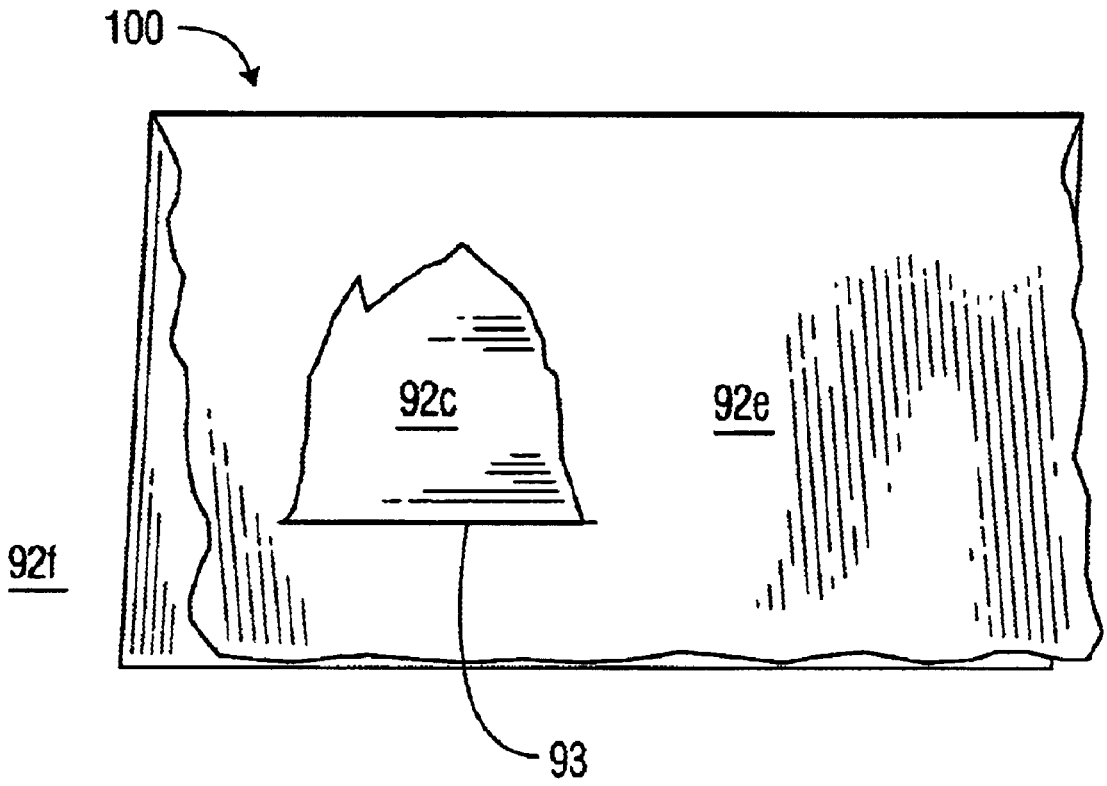
FIG. 11 is a perspective view of a multi-dimensional print medium that can be made from the sheet of FIG. 10.
Figure 12:
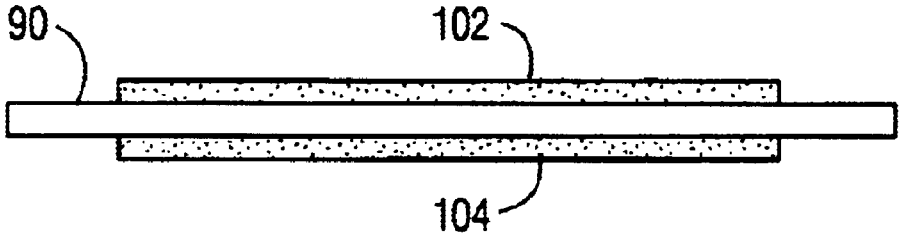
FIG. 12 is a side view of the sheet of FIG. 10, showing a sheet of print media in simplified, and greatly enlarged, form.

FIG. 10 shows a sheet 90 of print media including a segment or active area 92 for creating a mailer 100 such as illustrated in FIG. 11. Mailer 100 has print indicia on both sides, indicated in FIG. 12 by print medium 102 on the top and print medium 104 on the bottom. As such, mailer 100 will benefit from keeping its scoring ridges low, which correspond with and are on the other side of sheet 90 (FIG. 10) from scoring lines 106. Keeping the ridges low is described just above. Other die patterns are also shown, such as cutting used to create slit 93, microperfing 108 and nicks 109. The die patterns follow legend 36 of FIG. 2.

In further detail, FIG. 10 shows portions 92*a*–92*f* of segment 92, and a slit 93 in portion 92*e*. Alignment hole 111 may function like alignment hole 38 of FIG. 2. Hole 107 is an optional part of the design of the mailer. To keep the sheet intact when passing through a printing device, nicks (e.g., 109) may need to be somewhat closely spaced apart along the leading edge of active area 92, i.e., the edge of area 92 first fed into a printing device. The trailing edges of the area am then typically be less closely spaced apart. FIG. 11 shows mailer 100 in a multi-dimensional form, as that term is used herein. In this regard, the top of portion 92*c* extends away from portion 92*e*, and the bottom of portion 92*e* extends away from portion 92*f*, for instance. Thus, a visual scene (as that term is used herein) in FIG. 11 includes portions 92*c* and 92*e* that are intended to be viewed together, as shown. A multi-dimensional appearance, as that term is used herein, results from showing at least two layers (e.g., 92*c* and 92*e*) of the sheet in different planes in a visual scene.

Figure 13:
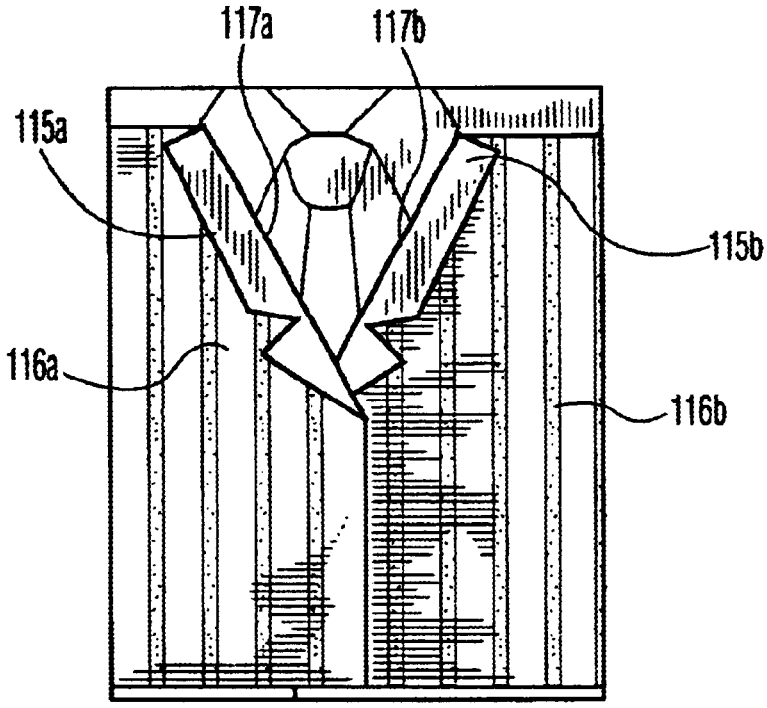
FIG. 13 is a plan view of a fragmentary portion of a multi-dimensional print medium that can be produced according to the present invention.
Figure 14:
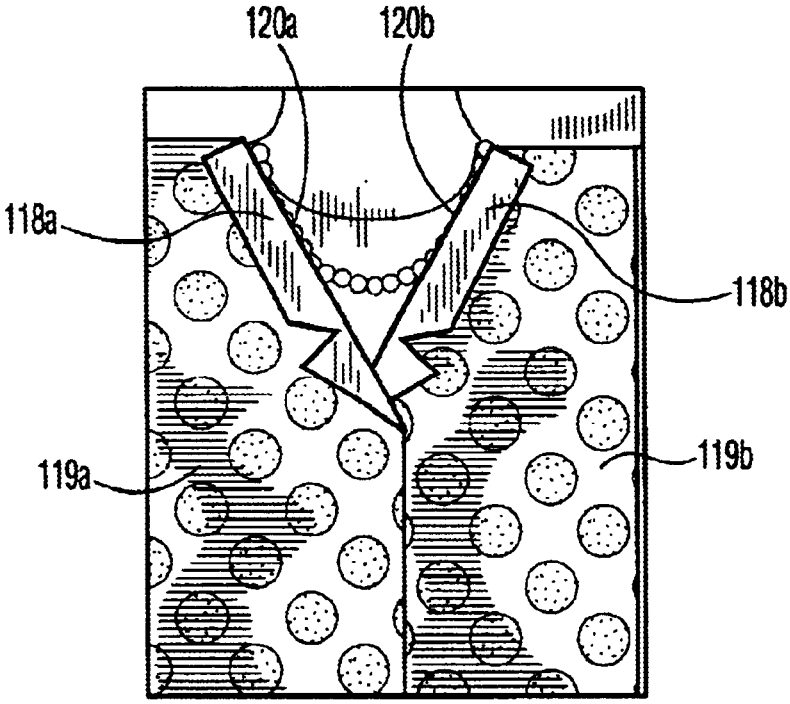
FIG. 14 is similar to FIG. 13 but shows another image that can easily replace the image shown in FIG. 13.

FIGS. 13 and 14, in which contrasting color is shown by stippling, illustrate different print images that can be easily interchanged using the present invention. That is, a consumer can purchase unprinted sheets of print media that are already die pressed to create a desired shape. The image of FIG. 13 can be economically interchanged with the image of FIG. 14, for example, by printing the desired image. This contrasts with the prior art method of first printing a sheet and then die pressing it, which necessitates, in changing an image, an entire and usually costly production run.

FIG. 13 shows lapels 115*a* and 115*b* attached to underlying jacket portions 116*a* and 116*b* along respective folds 117*a* and 117*b*. Similarly, FIG. 14 shows lapels 118*a* and 118*b* attached to underlying jacket portions 119*a* and 119*b* along respective folds 120*a* and 120*b*. The lapels and the underlying jacket portions form a multi-dimensional image as defined above in connection with FIG. 11.

Figure 15:
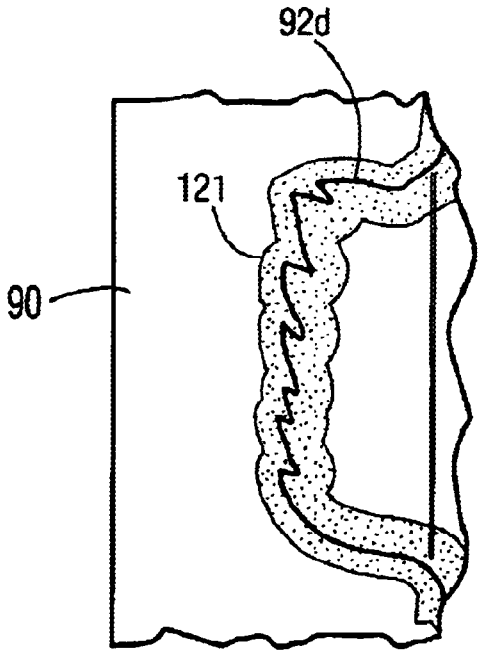
FIG. 15 is a plan view of a fragmentary portion of an electronic matrix image.
Figure 16:
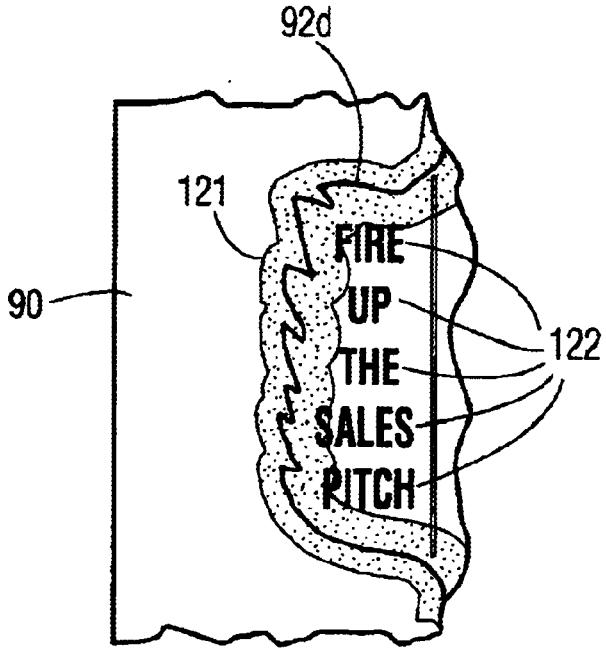
FIG. 16 is similar to FIG. 15 but shows a customized fill-in image added to the matrix image.

FIGS. 15 and 16 show an electronic matrix image 121 (FIG. 15) for positioning on phantom-shown portion 92*e* of sheet 90 (FIG. 10), which can then be customized with a customizable fill-in image 122 (FIG. 16). The resulting image (FIG. 16) is then printed onto the sheet. An electronic matrix image can be provided in a computer file from the Internet, a computer illustration program, or a standalone image scanner or one included in a photocopier, for example.

Figure 17:
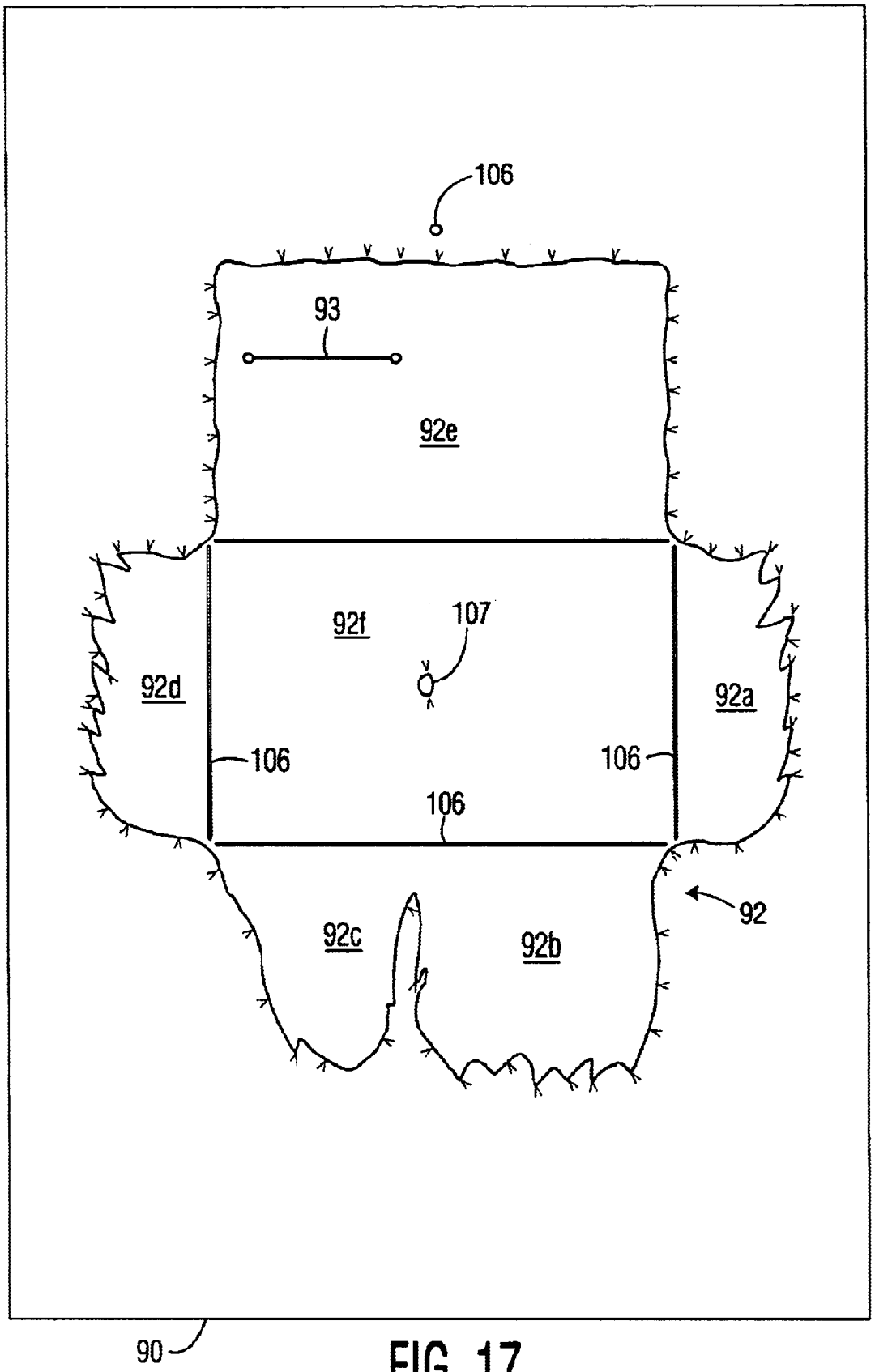
FIG. 17 is similar to FIG. 10, showing a variation in how an active region is attached to the rest of the sheet.

FIG. 17 is similar to FIG. 10, but shows a sheet 90 of print media in which the entire outer periphery of active region 92 is cut (e.g., at 124) except for nicks (e.g., 126). The nicks adequately hold the active region to the rest of the sheet so as to keep the sheet sufficiently intact while passing through a printing device so as to prevent malfunction of the printing device. The die patterns follow legend 36 of FIG. 2.

While paper ranging from bond paper with a weight of 75 grams per square meter to card stock with a weight of 570 grams per square meter are presently preferred as print media, other material can be used such as rubberized magnets, plastic sheets, sheets made with plastic resin, silicone sheets, linen and vinyl.

Typical printing devices for the invention include digital color copiers, black and white copiers, ink jet printers, and laser printers. A straight-though paper path is preferred, but is not necessary if the printing device is capable of handling the print media (e.g., paper or card stock) in question.

The various tolerance features of the invention (e.g., alignment hole 38, FIG. 2 and tolerance band 59, FIG. 4) facilitate consistently accurate placement of images on print media without substantial distortion.

While the invention has been described with respect to specific embodiments by way of illustration, many modifications and changes will occur to those of ordinary skill in the art. It is, therefore, to be understood that the appended claims are intended to cover all such modifications and changes as fall within the true scope and spirit of the invention.

What is claimed is:

1. Method of producing multi-dimensional print media, comprising the steps of:

a) providing a substantially flat sheet of print media that is bounded by a periphery;

b) providing an image for printing on a first side of the sheet; the image including an active area that eventually separates from the rest of the sheet; the active area being bounded by a periphery; a majority of the periphery of the active area being spaced from the periphery of the sheet;

c) performing one or both of a step of microperfing a substantial portion of the periphery and a step of cutting a substantial portion of the periphery of the active area except for nick regions used to hold the associated portion of the active area to the rest of the sheet;

d) scoring the first side of the sheet in the active area to provide at least one fold line for facilitating folding of the active area of the sheet into a multidimensional shape using only the at least one fold line for folding; and e) after the step of one or both of microperfing and cutting, printing the image on the first side of the sheet with a printing device;

f) the multidimensional shape comprising at least two overlapping layers with at least some adjacent portions of adjacent layers being selectively extended away from each other; and g) the step of printing includes printing on the overlapping layers a plurality of respective images, such that each of a plurality of layers each has a respective image, which respective images are intended to be viewed together as a visual scene.

2. The method of claim 1, wherein the step of performing includes the step of cutting at least about 85 percent of the periphery of the active area.

3. Method of producing multi-dimensional print media, comprising the steps of:

a) providing a substantially flat sheet of print media that is bounded by a periphery;

b) providing an image for printing on a first side of the sheet; the image including an active area that eventually separates from the rest of the sheet; the active area being bounded by a periphery; a majority of the periphery of the active area being spaced from the periphery of the sheet;

c) performing one or both of a step of microperfing a substantial portion of the periphery and a step of cutting a substantial portion of the periphery of the active area except for nick regions used to hold the associated portion of the active area to the rest of the sheet;

d) scoring the first side of the sheet in the active area to provide at least one fold line for facilitating folding of the active area of the sheet into a multi-dimensional shape using only the at least one fold line for folding;

e) after the step of one or both of microperfing and cutting, printing the image on the first side of the sheet with a printing device;

f) the step of scoring including forming a ridge on the first side of the sheet corresponding to the at least one fold line; and g) the step of printing includes printing the image across the ridge, on the first side of the sheet, with a print medium;

h) the scoring being performed in such a manner as to keep the ridge low in height so as to prevent a colored region crossing over the ridge having a substantially lighter color near each side of the ridge.

4. The method of claim 3, wherein any of the cutting, microperfing or scoring is performed by a single diehead that is pressed against the sheet in one operation.

5. The method of claim 4, wherein the ridge has a height of less than about 6 mils.

6. The method of claim 4, wherein the ridge has a height of less than about 3 mils.

7. The method of claim 4, wherein the ridge has a height of less than about 2 mils.

8. The method of claim 4, wherein the step of printing includes printing an image on the second side of the sheet, whereby the sheet has images on both sides.

9. The method of claim 1, 3 or 4, wherein the step of printing comprises one of electrostatic image printing and ink jet printing.

10. The method of claim 1, 3 or 4, wherein the step of performing comprises the step of cutting a substantial portion of the periphery of the active area except for nick regions used to hold the associated portion of the active area to the rest of the sheet.

11. The method of claim 3, wherein the ridge has a height of less than about 6 mils.

12. The method of claim 3, wherein the ridge has a height of less than about 3 mils.

13. The method of claim 3, wherein the ridge has a height of less than about 2 mils.

14. Method of producing multi-dimensional print media, comprising the steps of:

a) providing a substantially flat sheet of print media that is bounded by a periphery;

b) providing an image for printing on a first side of the sheet; the image including an active area that eventually separates from the rest of the sheet; the active area being bounded by a periphery; a majority of the periphery of the active area being spaced from the periphery of the sheet;

c) performing one or both of a step of microperfing a substantial portion of the periphery and a step of cutting a substantial portion of the periphery of the active area except for nick regions used to hold the associated portion of the active area to the rest of the sheet;

d) scoring the first side of the sheet in the active area to provide at least one fold line for facilitating folding of the active area of the sheet into a multi-dimensional shape using only the at least one fold line for folding;

e) after the step of one or both of microperfing and cutting, printing the image on the first side of the sheet with a printing device;

f) before printing, deforming an area of the sheet; and g) printing a mark on the sheet intended to be aligned with the deformed area;

h) the shape of the deformed area being selected to allow easy visual indication of whether alignment is proper.

15. The method of claim 1, 3 or 4, wherein the step of performing includes the step of cutting at least about 75 percent of the periphery of the active area.

16. The method of claim 15, wherein substantially the entire periphery of the active area is spaced from the periphery of the sheet.

17. The method of claim 14, wherein proper alignment is indicated by one of the deformed area and the mark being within the periphery of a generally enclosed shape of the other.

18. The method of claim 17, wherein:

a) the deformed area is a generally circular hole in the sheet; and b) the mark is a generally round indicia larger in size than the diameter of the hole.

19. Method of producing multi-dimensional print media, comprising the steps of:

a) providing a substantially flat sheet of print media;

b) providing an image for printing on a first side of the sheet; the image including an active area that eventually separates from the rest of the sheet; the active area being bounded by a periphery;

c) performing one or both of cutting and microperfing a substantial portion of the periphery that adjoins an adjacent portion of the sheet;

d) scoring the first side of the sheet in the active area to provide at least one fold line for facilitating folding of the active area of the sheet into a multi-dimensional shape using only the at least one fold line for folding;

e) printing the image on the first side of the sheet with a printing device;

f) the foregoing performing step being carried out in such manner as to keep the sheet sufficiently intact while passing through a printing device so as to prevent malfunction of the printing device;

g) before printing, deforming an area of the sheet; and;

h) printing a mark on the sheet intended to be aligned with the deformed area;

i) the shape of the deformed area being selected to allow easy visual indication of whether alignment is proper.

20. The method of claim 1, 3, 4 or 14, wherein the sheet comprises paper.

21. The method of claim 19 wherein proper alignment is indicated by one of the deformed area and the mark being within the periphery of a generally enclosed shape of the other.

22. The method of claim 21, wherein:

a) the deformed area is a generally circular hole in the sheet; and b) the mark is a generally round indicia larger in size than the diameter of the hole.

* * * * *